US011263969B2

(12) United States Patent
Yang et al.

(10) Patent No.: US 11,263,969 B2
(45) Date of Patent: Mar. 1, 2022

(54) PIXEL CIRCUIT, PARAMETER DETECTION METHOD, DISPLAY PANEL AND DISPLAY DEVICE

(71) Applicant: BOE TECHNOLOGY GROUP CO., LTD., Beijing (CN)

(72) Inventors: Fei Yang, Beijing (CN); Song Meng, Beijing (CN); Xiaolong Wei, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/937,486

(22) Filed: Jul. 23, 2020

(65) Prior Publication Data

US 2021/0065629 A1 Mar. 4, 2021

(30) Foreign Application Priority Data

Aug. 30, 2019 (CN) ..... 201910814724.2

(51) Int. Cl.
*G09G 3/3208* (2016.01)
*G09G 3/3258* (2016.01)
(Continued)

(52) U.S. Cl.
CPC ..... *G09G 3/3258* (2013.01); *G09G 3/3266* (2013.01); *G09G 3/3275* (2013.01);
(Continued)

(58) Field of Classification Search
CPC .. G09G 3/3208; G09G 3/3225; G09G 3/3233; G09G 3/3258; G09G 3/3266;
(Continued)

(56) References Cited

U.S. PATENT DOCUMENTS 9,111,492 B2 * 8/2015 Kim ..... G09G 3/3233
9,727,186 B2 * 8/2017 Yang ..... G06F 3/04184
(Continued)

FOREIGN PATENT DOCUMENTS

CN 104809986 A 7/2015
CN 105243996 A 1/2016
(Continued)

OTHER PUBLICATIONS

State Intellectual Property Office of the People's Republic of China, Office Action and Search Report Issued in Application No. 201910814724.2, dated Jan. 29, 2021, 20 pages. (Submitted with Partial Translation).

(Continued)

*Primary Examiner* — Michael J Eurice
(74) *Attorney, Agent, or Firm* — McCoy Russell LLP

(57) ABSTRACT

A pixel circuit, a parameter detection method, a display panel and a display device are provided. The pixel circuit includes a data writing-in circuit, a driving circuit, a reset control circuit, a detection control circuit, and a light emitting element. The detection control circuit is configured to control the connection or disconnection between the first electrode of the light emitting element and the sensing line under the control of a detection control signal provided by the detection control line. The reset control circuit is configured to control the connection or disconnection between the first electrode of the light emitting element and the second electrode of the light emitting element under the control of a reset control signal provided by the reset control line.

17 Claims, 7 Drawing Sheets

(51) Int. Cl.
*G09G 3/3266* (2016.01)
*G09G 3/3275* (2016.01)

(52) U.S. Cl.
CPC . *G09G 2300/0819* (2013.01); *G09G 2310/08* (2013.01); *G09G 2320/02* (2013.01); *G09G 2330/028* (2013.01)

(58) Field of Classification Search
CPC ..... G09G 3/3275; G09G 2300/0819; G09G 2300/0842; G09G 2310/061; G09G 2310/066; G09G 2310/08; G09G 2320/02; G09G 2320/0233; G09G 2320/0295; G09G 2320/045; G09G 2330/028
See application file for complete search history.

(56) References Cited

U.S. PATENT DOCUMENTS

2008/0278464 A1* 11/2008 Yamamoto ..... G09G 3/3233 345/204
2010/0259527 A1* 10/2010 Odawara ..... G09G 3/3233 345/211
2011/0063283 A1* 3/2011 Ryu ..... G09G 3/3283 345/214
2011/0109660 A1* 5/2011 Kim ..... G09G 3/3233 345/690
2011/0279444 A1* 11/2011 Chung ..... G09G 3/3233 345/214
2013/0169699 A1* 7/2013 Jeong ..... G09G 3/3225 345/690
2014/0333680 A1* 11/2014 Choi ..... H05B 45/60 345/690
2015/0029171 A1* 1/2015 Jo ..... G09G 3/3258 345/212
2015/0187276 A1* 7/2015 Shim ..... G09G 3/3233 345/77
2015/0379923 A1* 12/2015 Lee ..... H01L 27/3272 345/206
2016/0098961 A1 4/2016 Han et al.
2016/0246409 A1* 8/2016 Yang ..... G09G 3/3233
2017/0018224 A1* 1/2017 Lee ..... G09G 3/3233
2017/0031485 A1* 2/2017 Kim ..... G09G 3/3233
2017/0060317 A1* 3/2017 Kim ..... G06F 3/0412
2017/0061877 A1* 3/2017 Lee ..... H01L 27/3262
2017/0061892 A1* 3/2017 Jung ..... G09G 3/3291
2017/0116918 A1* 4/2017 Dong ..... G09G 3/3233
2017/0169767 A1 6/2017 Song
2017/0256198 A1 9/2017 Hwang et al.
2017/0316738 A1* 11/2017 Sohn ..... G09G 3/3233
2017/0345368 A1* 11/2017 Kim ..... G09G 3/3233
2018/0061293 A1* 3/2018 Park ..... G09G 3/3225
2018/0190194 A1* 7/2018 Zhu ..... H01L 27/3265
2018/0342205 A1 11/2018 Wang et al.
2019/0139492 A1* 5/2019 Chen ..... G09G 3/3233
2019/0164476 A1 5/2019 Feng et al.
2019/0252473 A1* 8/2019 Park ..... H01L 27/3234
2019/0355802 A1* 11/2019 Shim ..... H01L 27/326
2020/0035159 A1 1/2020 Lin et al.

FOREIGN PATENT DOCUMENTS

CN 105489159 A 4/2016
CN 106856086 A 6/2017
CN 107016965 A 8/2017
CN 107731171 A 2/2018
CN 107767814 A 3/2018
CN 108806599 A 11/2018
CN 109584801 A * 12/2018 ..... G09G 3/3225
CN 109584801 A * 4/2019
CN 109584801 A 4/2019
CN 109616050 A 4/2019
CN 109935205 A 6/2019

OTHER PUBLICATIONS

State Intellectual Property Office of the People's Republic of China, Office Action and Search Report Issued in Application No. 201910814724.2, dated Aug. 3, 2020, 17 pages. (Submitted with Partial Translation).

* cited by examiner

PIXEL CIRCUIT, PARAMETER DETECTION METHOD, DISPLAY PANEL AND DISPLAY DEVICE

CROSS-REFERENCE TO RELATED APPLICATION

The present application claims a priority of the Chinese patent application No. 201910814724.2 filed on Aug. 30, 2019, which is incorporated herein by reference in its entirety.

TECHNICAL FIELD

The present disclosure relates to the field of display technology, in particular to a pixel circuit, a parameter detection method, a display panel and a display device.

BACKGROUND

Nowadays, people not only have strict demands on the appearance and quality of products, but also pay more attention to the price and practicality of products. In the display field, especially the field of organic light emitting diode (OLED) display, due to its functions such as a wide color gamut, a wide viewing angle, thin and light, low energy consumption, high contrast, flexible, OLED displays have been widely accepted by the people, and gradually become the future development direction of display technology. However, in the field of large-size OLED display, due to its oxide process, the unstable characteristics of thin film transistor TFT (TFT) is its biggest disadvantage. The instability of TFT causes the deterioration of the image quality, and how to improve the image quality has always been the direction of technical personnel.

A conventional large-size OLED display device improves the image quality by using external compensation methods. For the display device, the image is displayed in a unit of a frame. There will be a frame idle time between adjacent frames. The principle of a traditional external compensation method is that the parameter detection is performed on a row of pixel units during the frame idle time, that is, parameters of one row of pixel circuits can be sensed in one frame, and the detection speed of the parameters is slow, which leads to a slow compensation speed.

SUMMARY

The present disclosure provides a pixel circuit, including a data writing-in circuit, a driving circuit, a reset control circuit, a detection control circuit, and a light emitting element, wherein the data writing-in circuit is electrically connected to a gate line, a data line, and a control end of the driving circuit, respectively, and is configured to control the connection or disconnection between the data line and the control end of the driving circuit under the control of a gate driving signal provided by the gate line; a first end of the driving circuit is electrically connected to a power supply voltage end, a second end of the driving circuit is electrically connected to a first electrode of the light emitting element, and the driving circuit is configured to control the connection or disconnection between the power supply voltage end and the first electrode of the light emitting element under the control of a potential of the control end of the driving circuit; the detection control circuit is electrically connected to a detection control line, the first electrode of the light emitting element, and a sensing line, respectively, and is configured to control the connection or disconnection between the first electrode of the light emitting element and the sensing line under the control of a detection control signal provided by the detection control line, a second electrode of the light emitting element is electrically connected to a first voltage end; and the reset control circuit is electrically connected to a reset control line, the first electrode of the light emitting element and the second electrode of the light emitting element respectively, and is configured to control the connection or disconnection between the first electrode of the light emitting element and the second electrode of the light emitting element under the control of a reset control signal provided by the reset control line.

In some embodiments of the present disclosure, the reset control circuit comprises a reset control transistor, a control electrode of the reset control transistor is electrically connected to the reset control line, a first electrode of the reset control transistor is electrically connected to the first electrode of the light emitting element, and a second electrode of the reset control transistor is electrically connected to the second electrode of the light emitting element.

In some embodiments of the present disclosure, the data writing-in circuit comprises a data writing-in transistor, a control electrode of the data writing-in transistor is electrically connected to the gate line, a first electrode of the data writing-in transistor is electrically connected to the data line, and a second electrode of the data writing-in transistor is connected to the control end of the driving circuit.

In some embodiments of the present disclosure, the driving circuit comprises a driving transistor and a storage capacitor, a control electrode of the driving transistor is electrically connected to the second electrode of the data writing-in transistor, a first electrode of the driving transistor is electrically connected to a power supply voltage end, and a second electrode of the driving transistor is connected to the first electrode of the light emitting element; and a first end of the storage capacitor is electrically connected to the control electrode of the driving transistor, and a second end of the storage capacitor is electrically connected to the second electrode of the driving transistor.

In some embodiments of the present disclosure, the detection control circuit comprises a detection control transistor, a control electrode of the detection control transistor is electrically connected to the detection control line, a first electrode of the detection control transistor is electrically connected to the first electrode of the light emitting element, and a second electrode of the detection control transistor is electrically connected to the sensing line.

In some embodiments of the present disclosure, the first voltage end is a low voltage end.

In some embodiments of the present disclosure, the light emitting element is an organic light emitting diode, a first electrode of the light emitting element is an anode of the organic light emitting diode, and a second electrode of the light emitting element is a cathode of the organic light emitting diode.

In a second aspect, a parameter detection method applied to the pixel circuit, wherein the parameter detection method includes: controlling, by the reset control circuit, connection or disconnection between the first electrode of the light emitting element and the second electrode of the light emitting element under the control of the reset control signal provided by the reset control line; controlling, by the detection control circuit, connection or disconnection between the first electrode of the light emitting element and the sensing line under the control of the detection control signal provided by the detection control line; and controlling, by the data writing-in circuit, connection or disconnection between the data line and the control end of the driving circuit under the control of the gate driving signal provided by the gate line.

In some embodiments of the present disclosure, a first parameter detection period includes a first reset phase and a first detection phase, and the parameter detection method includes: in the first reset phase, the reset control circuit controlling the connection between the first electrode of the light emitting element and the second electrode of the light emitting element under the control of the reset control signal provided by the reset control line to control the light emitting element not to emit light; the data writing-in circuit controlling the connection between the data line and the control end of the driving circuit under the control of the gate driving signal provided by the gate line to reset the potential of the control end of the driving circuit to the first reset voltage; the detection control circuit controlling the connection between the first electrode of the light emitting element and the sensing line under the control of the detection control signal provided by the detection control line to reset the voltage of the sensing line; and in the first detection phase, the reset control circuit controlling the disconnection between the first electrode of the light emitting element and the second electrode of the light emitting element under the control of the reset control signal; the data writing-in circuit controlling the disconnection between the data line and the control end of the driving circuit under the control of the gate driving signal; the detection control circuit controlling the connection between the first electrode of the light emitting element and the sensing line under the control of the detection control signal provided by the detection control line; the driving circuit controlling the connection between the power supply voltage end and the first electrode of the light emitting element under the control of the potential of the control end of the driving circuit, and generating a charging current flowing from the power supply voltage end to the first electrode of the light emitting element, charging parasitic capacitance on the sensing line through the charging current to increase the voltage of the sensing line; and the compensation gain value of the driving transistor included in the driving circuit being obtained based on the duration of the first detection phase, the first reset voltage and the voltage of the sensing line at the end of the first detection phase.

In some embodiments of the present disclosure, the first parameter detection period comprises a display phase of at least one of other rows of pixel circuits.

In some embodiments of the present disclosure, the compensation gain value is a threshold voltage of the driving transistor or a mobility of the driving transistor.

In some embodiments of the present disclosure, the second parameter detection period includes a second reset phase and a second detection phase, the second detection phase includes a plurality of detection sub-phases that are sequentially set, and the detection sub-phase includes a charging time period and a charge reset time period that are sequentially set, the parameter detection method includes: in the second reset phase, the reset control circuit controlling the connection between the first electrode of the light emitting element and the second electrode of the light emitting element under the control of the reset control signal provided by the reset control line to control the light emitting element not to emit light; the data writing-in circuit controlling the connection between the data line and the control end of the driving circuit under the control of the gate driving signal provided by the gate line to reset the potential of the control end of the driving circuit to the second reset voltage; the detection control circuit controlling the connection between the first electrode of the light emitting element and the sensing line under the control of the detection control signal provided by the detection control line to reset the voltage of the sensing line; during the charging period, the reset control circuit controlling the disconnection between the first electrode of the light emitting element and the second electrode of the light emitting element under the control of the reset control signal; the data writing-in circuit controlling the disconnection between the data line and the control end of the driving circuit under the control of the gate driving signal; the detection control circuit controlling the connection between the first electrode of the light emitting element and the sensing line under the control of the detection control signal provided by the detection control line; the driving circuit controlling the connection between the power supply voltage end and the first electrode of the light emitting element under the control of the potential of the control end of the driving circuit, and generating a charging current flowing from the power voltage end to the first electrode of the light emitting element, the charging current being used to charge the parasitic capacitance on the sensing line to increase the voltage of the sensing line; and during the charge reset period, the data writing-in circuit controlling the data line to write a second reset voltage to the control end of the driving circuit under the control of the gate driving signal; the detection control circuit controlling the connection between the first electrode of the light emitting element and the sensing line under the control of the detection control signal provided by the detection control line, to generate a charging current flowing from the power supply voltage end to the first electrode of the light emitting element, and the charging current being used to charge the parasitic capacitance on the sensing line to increase the voltage of the sensing line; and the compensation gain value of the driving transistor included in the driving circuit being obtained based on the voltage of the sensing line at the end of the last detection sub-phase.

In some embodiments of the present disclosure, at the end of the last detection sub-phase, the voltage of the sensing line is increased to enable the driving circuit to disconnect the first end of the driving circuit from the second end of the driving circuit.

In some embodiments of the present disclosure, the second parameter detection period comprises a display phase of at least one of other rows of pixel circuits.

In a third aspect, a display panel includes N rows and M columns of pixel circuits, pixel circuits in the mth column is electrically connected to an mth sensing line; N and M are positive integers, and m is a positive integer less than or equal to M.

In some embodiments of the present disclosure, the pixel circuit in the nth row is electrically connected to a gate line in the nth row, a detection control line in the nth row, and a reset control line in the nth row; n is a positive integer less than or equal to N.

In a fourth aspect, a display device includes the display panel.

In some embodiments of the present disclosure, the display device further includes a time sequence controller, a gate driver, a memory, and a source driver, the time sequence controller reads data stored in the memory, and simultaneously receives RGB data and a time sequence control signal inputted externally, and receives sensing data outputted by the source driver; after calculation, conversion and compensation and other algorithms, the time sequence controller generates a data voltage and a source control signal, and outputs the data voltage and the source control signal to the source driver, and the time sequence controller generates a gate driving signal, and outputs the gate driving signal to the gate driver; the memory stores pixel compensation values of one or more pixels of different pixels on an entire screen in different colors, and the pixel compensation values include an offset value for controlling an on-state of the pixels and a gain value for controlling a change rate of the luminance of the pixels; the source driver receives the compensated and calculated data voltage and source control signal outputted by the time sequence controller, the entire or part of the pixel feature values of a row is sensed by the sensing line, and the sensing data is generated by an analog-to-digital conversion, and the sensing data is outputted to the time sequence controller; the gate driver receives the gate control signal, generates at least one scan signal, and transmits the at least one scan signal to the display panel, the scan signal includes a detection control signal, a compensation control signal, and a gate driving signal; the source driver detects the voltage of the sensing line in the display panel and provides the data voltage to the data line in the display panel.

In some embodiments of the present disclosure, the time sequence controller includes a time sequence control unit, a luminance conversion unit, an algorithm compensation unit, a coefficient calculation unit, a storage control unit, and a data output unit; the time sequence control unit receives the time sequence control signal and generates a source control signal for controlling the source driver and a gate control signal for controlling the gate driver; the luminance conversion unit receives external RGB data, converts the external RBG data into a luminance signal, and outputs the luminance data to the algorithm compensation unit; the algorithm compensation unit receives the luminance data outputted by the luminance conversion unit and the compensation data outputted by the coefficient calculation unit, and outputs a voltage signal to the data output unit through a pixel compensation algorithm; the data output unit receives a voltage signal, converts the voltage signal into a digital voltage signal, and outputs the digital voltage signal to the source driver; the coefficient calculation unit receives sensing data outputted by the source driver, and converts the sensing data into a compensation offset value and a compensation gain value on a certain pixel through calculation; and after receiving the compensation offset value and the compensation gain value, the storage control unit writes all or part of the compensation data of a row into the memory under the control of the time sequence control unit.

DETAILED DESCRIPTION

The technical solutions in the embodiments of the present disclosure will be described clearly and completely with reference to the drawings in the embodiments of the present disclosure, and it is obvious that the embodiments described are only some embodiments of the present disclosure, rather than all embodiments. All other embodiments, which can be derived by a person skilled in the art from the embodiments disclosed herein without making any creative effort, shall fall within the protection scope of the present disclosure.

The transistors used in all embodiments of the present disclosure may be transistors, thin film transistors, or field effect transistors or other devices with the same characteristics. In the embodiments of the present disclosure, to distinguish two electrodes of a transistor except for a control electrode, one electrode is referred to as a first electrode, and the other electrode is referred to as a second electrode.

In practical operation, for a transistor, the control electrode may be a base electrode, the first electrode may be a collector electrode, and the second electrode may be an emitter electrode. Alternatively, the control electrode may be a base electrode, the first electrode may be an emitter electrode, and the second electrode may be a collector electrode.

In practical operation, when the transistor is a thin film transistor or a field effect transistor, the control electrode may be a gate electrode, the first electrode may be a drain electrode, and the second electrode may be a source electrode. Alternatively, the control electrode may be a gate electrode, the first electrode may be a source electrode, and the second electrode may be a drain electrode.

Figure 1:
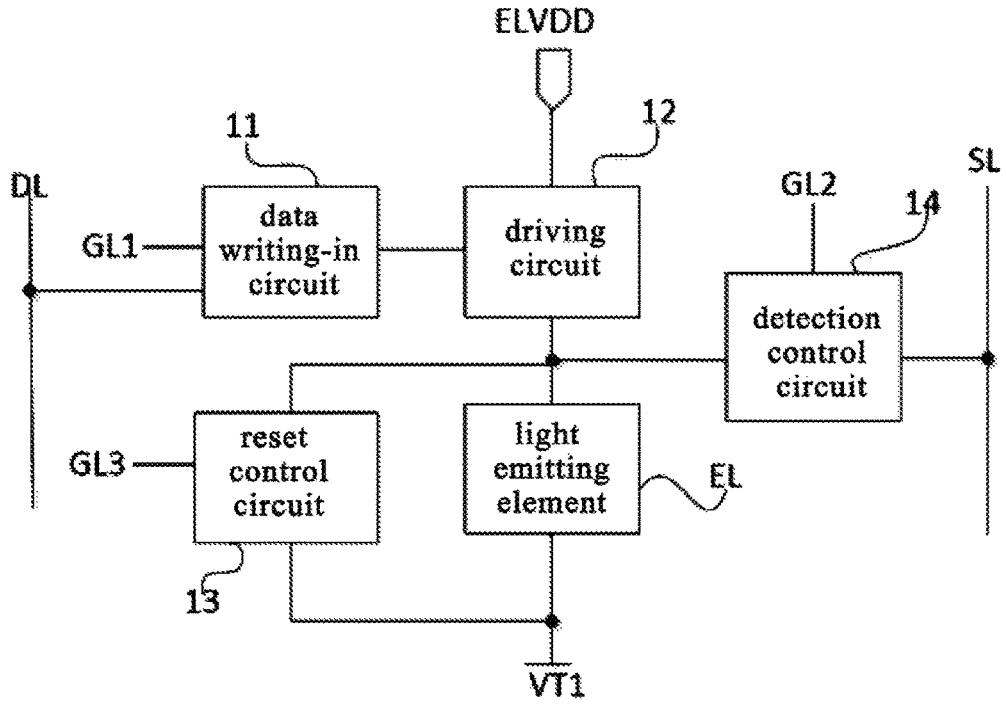
FIG. 1 is a structural diagram of a pixel circuit according to an embodiment of the present disclosure.

As shown in FIG. 1, a pixel circuit according to an embodiment of the present disclosure includes a data writing-in circuit 11, a driving circuit 12, a reset control circuit 13, a detection control circuit 14, and a light emitting element EL.

The data writing-in circuit 11 is electrically connected to a gate line GL1, a data line DL, and a control end of the driving circuit 12, respectively, and is used to control the connection or disconnection between the data line DL and the control end of the driving circuit 12 under the control of a gate driving signal provided by the gate line GL1.

A first end of the driving circuit 12 is electrically connected to a power supply voltage end ELVDD, a second end of the driving circuit 12 is electrically connected to a first electrode of the light emitting element EL, and the driving circuit 12 is used to control the connection or disconnection between the power supply voltage end ELVDD and the first electrode of the light emitting element EL under the control of the potential of the control end of the driving circuit 12.

The detection control circuit 14 is electrically connected to a detection control line GL2, the first electrode of the light emitting element EL, and a sensing line SL, respectively, and is used to control the connection or disconnection between the first electrode of the light emitting element EL and the sensing line SL under the control of a detection control signal provided by the detection control line GL2. A second electrode of the light emitting element EL is electrically connected to a first voltage end VT1.

The reset control circuit 13 is electrically connected to a reset control line GL3, the first electrode of the light emitting element EL and the second electrode of the light emitting element EL, respectively, and is used to control the connection or disconnection between the first electrode of the light emitting element EL and the second electrode of the light emitting element EL under the control of a reset control signal provided by the reset control line GL3.

In the pixel circuit according to an embodiment of the present disclosure, the reset control circuit 13 controls the connection between the first electrode of the light emitting element EL and the second electrode of the light emitting element EL in a reset phase under the control of the reset control signal provided by the reset control line GL3, so as to control the light emitting element EL not to emit light. The detection control circuit 14 controls the connection or disconnection between the first electrode of the light emitting element EL and the sensing line SL under the control of the detection control signal provided by the detection control line GL2, so that the reset control of the light emitting element EL can be performed through GL3, and the detection switch control can be performed through GL2 to perform parameter detection on the pixel circuit in a non-display row, to achieve display driving and parameter detection at the same time, which can improve the speed of detecting parameter and the speed of compensating the data voltage based on the detected parameter, and improve the display quality of the display device.

In an embodiment of the present disclosure, the first voltage end VT may be a low voltage end, but not limited thereto.

In an embodiment of the present disclosure, the light emitting element EL may be an organic light emitting diode, the first electrode of the light emitting element EL is the anode of the organic light emitting diode, and the second electrode of the light emitting element EL is the cathode of the organic light emitting diode, but not limited to this.

When performing parameter detection on the pixel circuit shown in FIG. 1 of the present disclosure, a compensation gain value of the driving transistor included in the driving circuit may be detected during a first parameter detection period, and a compensation offset value of the driving transistor may be detected during a second parameter detection period.

The first parameter detection period may include a first reset phase and a first detection phase.

In the first reset phase, under the control of the reset control signal provided by the reset control line GL3, the reset control circuit 13 controls the connection between the first electrode of the light emitting element EL and the second electrode of the light emitting element EL to control the light emitting element EL not to emit light. The data writing-in circuit 11 controls the connection between the data line DL and the control end of the driving circuit 12 under the control of the gate driving signal provided by the gate line GL1, so as to reset the potential of the control end of the driving circuit 12 to the first reset voltage VREF1. Under the control of the detection control signal provided by the detection control line GL2, the detection control circuit 14 controls the connection between the first electrode of the light emitting element EL and the sensing line SL to reset the voltage of the sensing line SL.

In the first detection phase, the reset control circuit 13 controls the disconnection between the first electrode of the light emitting element EL and the second electrode of the light emitting element EL under the control of the reset control signal. The data writing-in circuit 11 controls the disconnection between the data line DL and the control end of the driving circuit 12 under the control of the gate driving signal. The detection control circuit 14 controls the connection between the first electrode of the light emitting element EL and the sensing line SL under the control of the detection control signal provided by the detection control line GL2. The driving circuit 12 controls the connection between the power supply voltage end ELVDD and the first electrode of the light emitting element EL under the control of the potential of the control end of the driving circuit 12, to generate a charging current flowing from ELVDD to the first electrode of the light emitting element EL to charge the parasitic capacitance on the sensing line SL through the charging current, so as to increase the voltage of the sensing line SL. The compensation gain value of the driving transistor included in the driving circuit 12 may be obtained based on the duration of the first detection phase, the first reset voltage VREF1 and the voltage of the sensing line SL at the end of the first detection phase.

In the embodiment of the present disclosure, the first parameter detection period may include a display phase of at least one of other rows of pixel circuits. That is, when the pixel circuit shown in FIG. 1 is in a non-display state, the pixel circuit shown in FIG. 1 can detect the compensation gain value of the driving transistor when the other rows of pixel circuits included in the display panel implements the display.

In the embodiment of the present disclosure, when the parameter detection is accurately implemented, the compensation gain value may be equal to the threshold voltage of the driving transistor, or the compensation gain value may be equal to the mobility of the driving transistor.

In a specific implementation, the second parameter detection period may include a second reset phase and a second detection phase. The second detection phase includes a plurality of detection sub-phases that are sequentially set, and the detection sub-phase includes a charging time period and a charge reset time period that are sequentially set.

In the second reset phase, the reset control circuit 13 controls the connection between the first electrode of the light emitting element EL and the second electrode of the light emitting element EL under the control of the reset control signal provided by the reset control line GL3 to control the light emitting element EL not to emit light. The data writing-in circuit 11 controls the connection between the data line DL and the control end of the driving circuit 12 under the control of the gate driving signal provided by the gate line GL1, so as to reset the potential of the control end of the driving circuit 12 to the second reset voltage VREF2. The detection control circuit 14 controls the connection between the first electrode of the light emitting element EL and the sensing line SL to reset the voltage of the sensing line SL under the control of the detection control signal provided by the detection control line GL2.

During the charging period, the reset control circuit 13 controls the disconnection between the first electrode of the light emitting element EL and the second electrode of the light emitting element EL under the control of the reset control signal; the data writing-in circuit 11 controls the disconnection between the control data line DL and the control end of the driving circuit 12 under the control of the gate driving signal GL1. The detection control circuit 14 controls the connection between the first electrode of the light emitting element EL and the sensing line SL under the control of the detection control signal provided by the detection control line GL2. The driving circuit 12 controls the connection between the power supply voltage end ELVDD and the first electrode of the light emitting element EL under the control of the potential of the control end of the driving circuit 12, to generate a charging current flowing from ELVDD to the first electrode of the light emitting element EL, to charge the parasitic capacitance on the sensing line SL through the charging current to increase the voltage of the sensing line SL.

During the charge reset period, the data writing-in circuit 11 controls the data line DL to write the second reset voltage VREF2 to the control end of the driving circuit 12 under the control of the gate driving signal, and the detection control circuit 14 controls the connection between the first electrode of the light emitting element EL and the sensing line SL under the control of the detection control signal provided by the detection control line GL2. The driving circuit 12 controls the connection between the power supply voltage end ELVDD and the first electrode of the light emitting element EL under the control of the voltage of the control end of the driving circuit 12, to generate a charging current flowing from the power supply voltage end ELVDD to the first electrode of the light emitting element EL, and charge the parasitic capacitance on the sensing line SL by the charging current to increase the voltage of the sensing line SL.

According to the voltage of the sensing line SL at the end of the last detection sub-phase, the compensation offset value of the driving transistor in the driving circuit 12 can be obtained.

Specifically, at the end of the last detection sub-phase, the voltage of the sensing line SL is increased to enable the driving circuit 12 to control the first end thereof to be disconnected from the second end of the driving circuit 12. That is, in actual operation, the duration of the second detection phase is controlled to be long enough so that the voltage of SL can be increased to turn off the driving transistor. At this time, the voltage of SL is Vs, and the compensation offset value of the driving transistor can be equal to VREF2-Vs.

In the disclosed embodiment of the present disclosure, the second parameter detection period may include a display phase of at least one of other rows of pixel circuits. That is, when the pixel circuit shown in FIG. 1 is in a non-display state, the pixel circuit shown in FIG. 1 can perform the detection on the compensation offset value of the driving transistor when the other rows of pixel circuits included in the display panel implement the display.

After detecting the compensation gain value and the compensation offset value of the driving transistor included in the driving circuit 12 in the pixel circuit shown in FIG. 1, when the pixel circuit shown in FIG. 1 implements the display, the compensation gain value and the compensation offset value are used to compensate the data voltage provided to the control electrode of the driving transistor by the data line DL, so that the display effect can be improved.

When performing parameter detection on the pixel circuits described in the embodiments of the present disclosure, during the display time of one frame of image, when other rows of pixel circuits performs display, the parameter detection may be performed on the pixel circuits described in the embodiments of the present disclosure. During the parameter detection, one row of the pixel circuits in the non-display state is reset, and at the same time another row of the pixel circuits in the non-display state is detected, which can increase the speed of parameter detection.

Specifically, the reset control circuit may include a reset control transistor. A control electrode of the reset control transistor is electrically connected to the reset control line, a first electrode of the reset control transistor is electrically connected to the first electrode of the light emitting element, and a second electrode of the reset control transistor is electrically connected to the second electrode of the light emitting element.

Specifically, the data writing-in circuit may include a data writing-in transistor. A control electrode of the data writing-in transistor is electrically connected to the gate line, a first electrode of the data writing-in transistor is electrically connected to the data line, and a second electrode of the data writing-in transistor is connected to the control end of the driving circuit.

Specifically, the driving circuit may include a driving transistor and a storage capacitor.

A control electrode of the driving transistor is electrically connected to the second electrode of the data writing-in transistor, a first electrode of the driving transistor is electrically connected to the power supply voltage end, and a second electrode of the driving transistor is connected to the first electrode of the light emitting element.

A first end of the storage capacitor is electrically connected to the control electrode of the driving transistor, and a second end of the storage capacitor is electrically connected to the second electrode of the driving transistor.

Specifically, the detection control circuit may include a detection control transistor. A control electrode of the detection control transistor is electrically connected to the detection control line, a first electrode of the detection control transistor is electrically connected to the first electrode of the light emitting element, and a second electrode of the detection control transistor is electrically connected to the sensing line.

Figure 2:
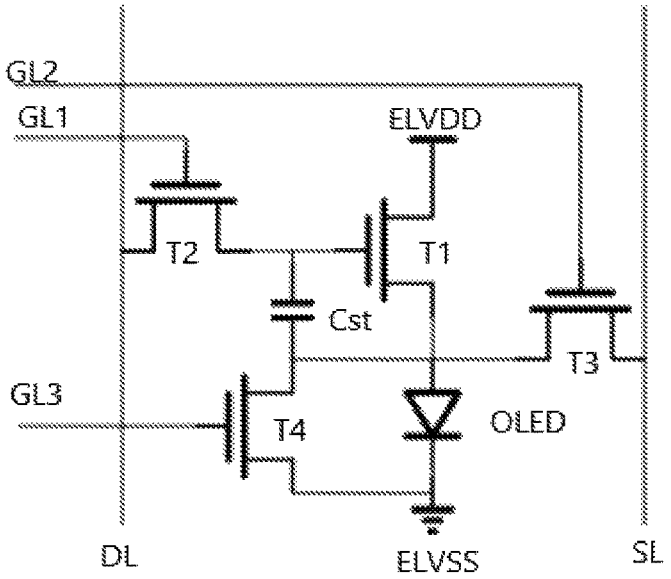
FIG. 2 is a circuit diagram of the pixel circuit according to an embodiment of the present disclosure.

As shown in FIG. 2, a specific embodiment of the pixel circuit disclosed in the present disclosure includes a data writing-in circuit 11, a driving circuit 12, a reset control circuit 13, a detection control circuit 14, and an organic light emitting diode OLED.

The reset control circuit 13 includes a reset control transistor T4. A gate electrode of the reset control transistor T4 is electrically connected to the reset control line GL3, a drain electrode of the reset control transistor T4 is electrically connected to the anode of the organic light emitting diode OLED, and a source electrode of the reset control transistor T4 is electrically connected to the cathode of the organic light emitting diode OLED, the cathode of the OLED is connected to a low voltage ELVSS.

The data writing-in circuit 11 includes a data writing-in transistor T2. A gate electrode of the data write transistor T2 is electrically connected to the gate line GL1, a drain electrode of the data write transistor T2 is electrically connected to the data line DL, and a source electrode of the data writing-in transistor T2 is connected to the gate electrode of the driving transistor T1.

The driving circuit 12 includes a driving transistor T1 and a storage capacitor Cst.

A gate electrode of the driving transistor T1 is electrically connected to a source electrode of the data writing-in transistor T2, a drain electrode of the driving transistor T1 is electrically connected to the power supply voltage end ELVDD, and the source electrode of the driving transistor T1 is connected to the anode of the organic LED.

The first end of the storage capacitor Cst is electrically connected to the gate electrode of the driving transistor T1, and the second end of the storage capacitor Cst is electrically connected to the source electrode of the driving transistor T1.

The detection control circuit 14 includes a detection control transistor T3. A gate electrode of the detection control transistor T3 is electrically connected to the detection control line GL2, a drain electrode of the detection control transistor T3 is electrically connected to the anode of the organic light emitting diode, a source electrode of the detection control transistor T3 is electrically connected to the sensing line SL.

In the specific embodiment of the pixel circuit shown in FIG. 2, all the transistors are N-type thin film transistors, but not limited to this.

Figure 3:
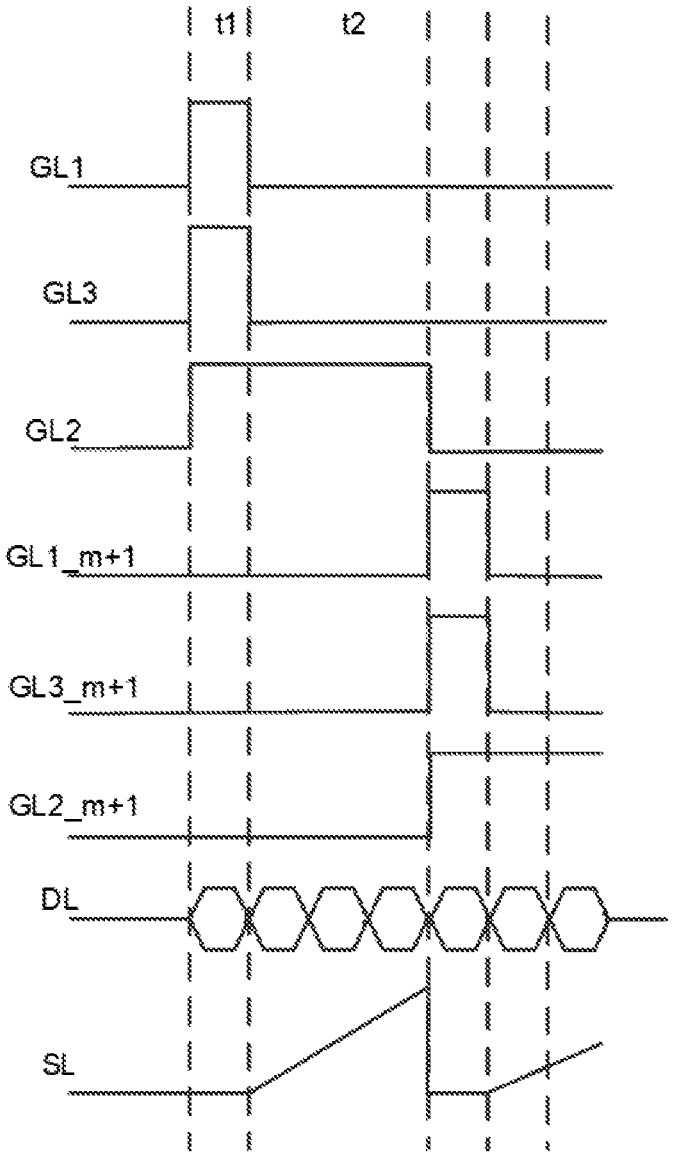
FIG. 3 is a first working time sequence diagram of the pixel circuit according to an embodiment of the present disclosure.

As shown in FIG. 3, when the specific embodiment of the pixel circuit shown in FIG. 2 is in operation, the first parameter detection period includes a first reset phase t1 and a first detection phase t2.

Figure 4A:
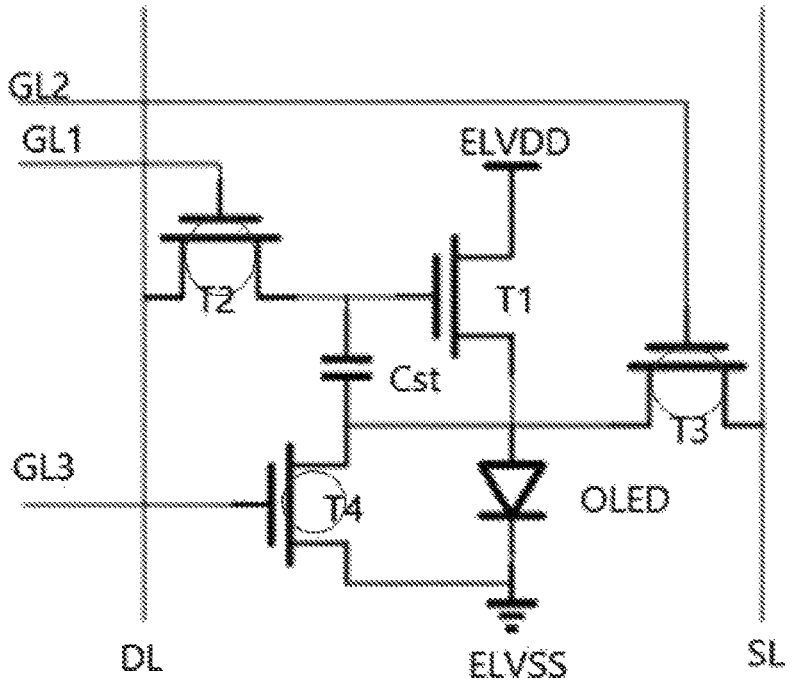
FIG. 4A is a schematic diagram of a working state of the pixel circuit in a first reset phase t1 according to an embodiment of the present disclosure.

In the first reset phase t1, GL1, GL2 and GL3 all input a high level, as shown in FIG. 4A, T2, T3 and T4 are turned on, the anode of OLED and the cathode of OLED are short circuited, the OLED does not emit light, and the voltage of SL is reset to ELELVSS; and DL input the first reset voltage VREF1 to the gate electrode of T1, so that at the beginning of the first detection phase t2, T1 can be turned on.

Figure 4B:
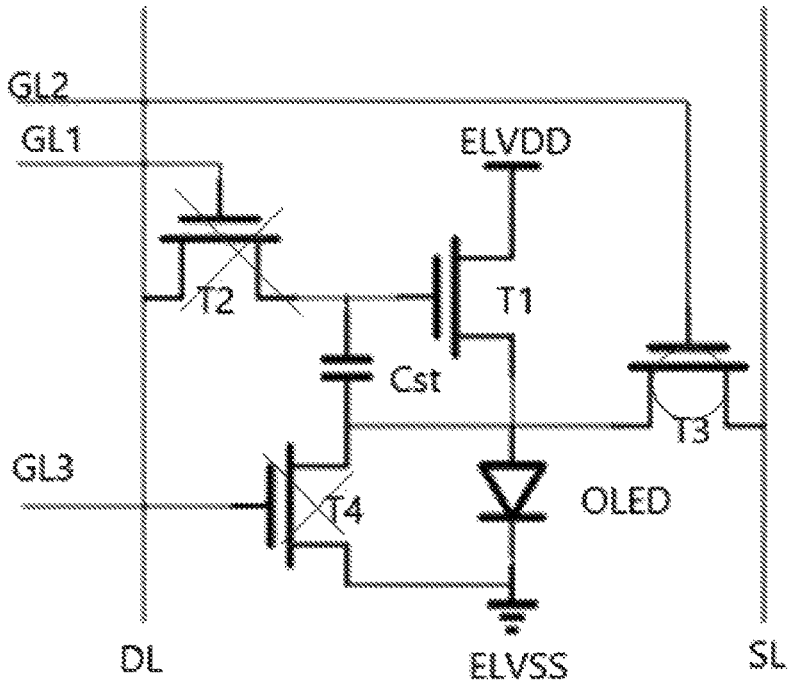
FIG. 4B is a schematic diagram of a working state of the pixel circuit in a first detection phase t2 according to an embodiment of the present disclosure.

In the first detection phase t2, GL1 and GL3 input a low level, GL2 input a high level, as shown in FIG. 4B, T4 and T2 are turned off, T3 is turned on, T1 is turned on under the control of VREF1 to which the gate electrode of T1 is connected, a charging current from ELVDD to the source electrode of T1 is generated, due to the parasitic capacitance and line resistance of SL, the voltage of SL is increased.

At the end of the first detection phase t2, the source driver will sense the voltage on SL to characterize the aging degree of the driving transistor T1. The compensation gain value K of the driving transistor T1 can be obtained based on the duration of the first detection phase t2, the first reset voltage VREF1 and the voltage of the sensing line SL at the end of the first detection phase t2.

In FIG. 3, the label GL1_$m$+1 is a gate line in the adjacent next row, the label GL2_$m$+1 is a detection control line in the adjacent next row, and the label GL3_$m$+1 is a reset control line in the adjacent next row, GL1_$m$+1, GL2_$m$+1 and GL3_$m$+1 are all electrically connected to the pixel circuits in the adjacent next row. In FIG. 3, the waveform corresponding to GL1_$m$+1 is the waveform of the gate driving signal provided by the gate line in the adjacent next row, the waveform corresponding to GL2_$m$+1 is the waveform of the detection control signal provided by the detection control line in the adjacent next row, and the waveform corresponding to GL3_$m$+1 is the waveform of the reset control signal provided by the reset control line in the adjacent next row.

In actual operation, by controlling the voltage value of VREF1 and the duration of the first detection phase t2, at the end of the first detection phase t2, the voltage difference between the voltage of the anode of the OLED and the ELVSS is less than the turning-on voltage of the OLED, so that when the parameter is detected, the OLED will not emit light, which will not affect the display effect.

For display panels with different scanning frequencies and different resolutions, each row of pixel units have a different charging time, and sensing the compensation gain value K may take the charging time of multiple rows of pixel units. Assuming the detection time of compensation gain value in each row takes the charging time of 40 rows of pixel units, and that the display panel includes 2250 rows of pixel circuits, the compensation gain value detection method adopted for the pixel circuit according to the embodiment of the present disclosure is compared to the traditional compensation gain value detection method, the efficiency can be increased by at least 2250/40 times, that is, by about 56 times.

In FIGS. 4A and 4B, circles represent that corresponding transistors are turned on, and crosses represent that corresponding transistors are turned off.

Figure 5:
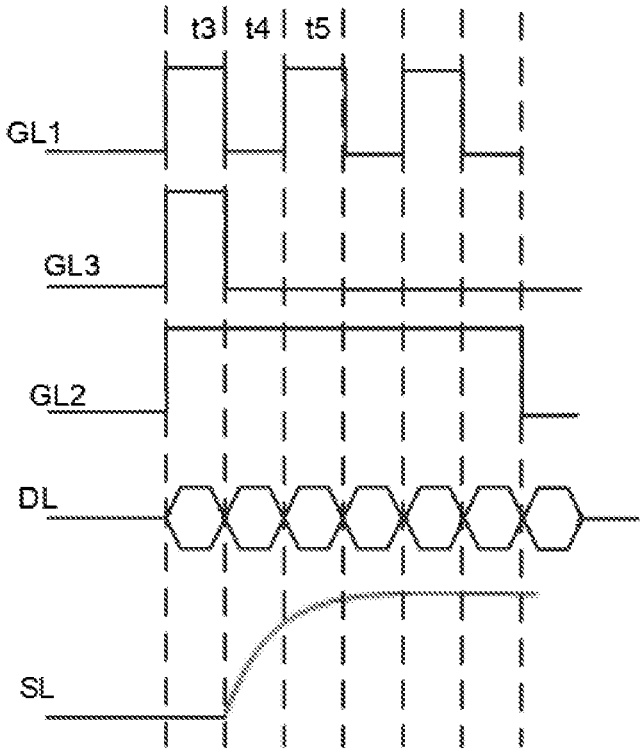
FIG. 5 is a second working time sequence diagram of the pixel circuit according to an embodiment of the present disclosure.

As shown in FIG. 5, when the specific embodiment of the pixel circuit shown in FIG. 2 is in operation, the second parameter detection period may include a second reset phase t3 and a second detection phase. The second detection phase includes a plurality of detection sub-phases set in sequence, each of the detection sub-phases includes a charging time period and a charging reset time period set in sequence.

In FIG. 5, the label t4 refers to the charging time period included in the first detection sub-phase in the second detection phase, and the label t5 refers to the charging reset time period included in the first detection sub-phase in the second detection phase.

Figure 6A:
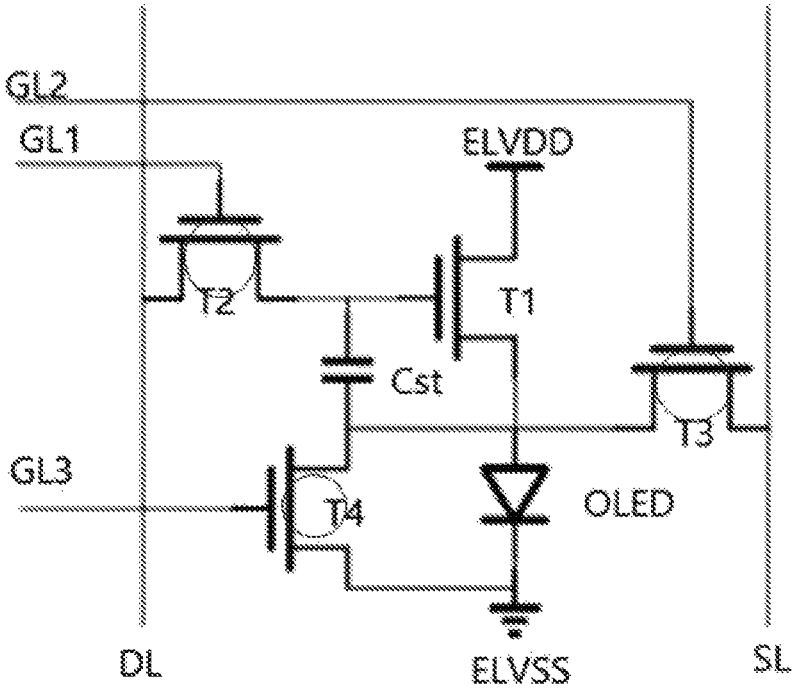
FIG. 6A is a schematic diagram of a working state of the pixel circuit in a second reset phase t3 according to an embodiment of the present disclosure.

In the second reset phase t3, GL1, GL2 and GL3 all input a high level, as shown in FIG. 6A, T2, T3 and T4 are turned on, the anode of OLED and the cathode of OLED are short circuited, the OLED does not emit light, and the voltage of SL is reset to ELELVSS; and DL inputs the second reset voltage VREF2 to the gate electrode of T1, so that at the beginning of the second detection phase, T1 can be turned on.

Figure 6B:
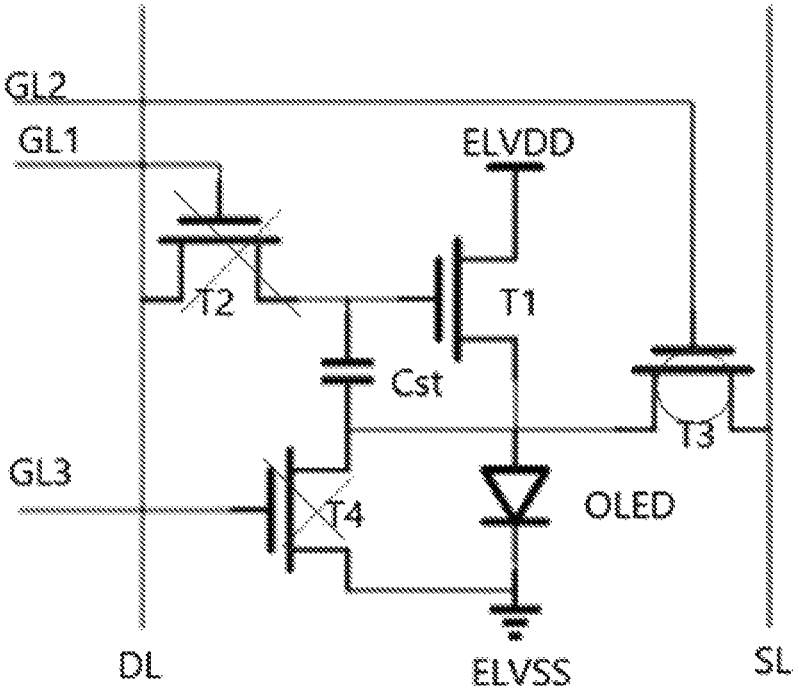
FIG. 6B is a schematic diagram of a working state of the pixel circuit in a charging phase t4 according to an embodiment of the present disclosure.

During the charging period t4, GL1 and GL3 input a low level, GL2 input a high level, as shown in FIG. 6B, T4 and T2 are turned off, T3 is turned off, and T1 is turned on under the control of VREF1 connected to the gate electrode of T3, a charging current from ELVDD to the source electrode of T1 is generated, and the charging current flows to SL through T3 which is turned on to charge the parasitic capacitance on SL, thereby increasing the voltage of SL.

Since T2 is turned off during the charging period t4, the gate voltage of T1 will rise due to the capacitance bootstrap effect, so the gate voltage of T1 needs to be reset after the charging period t4 is finished.

Figure 6C:
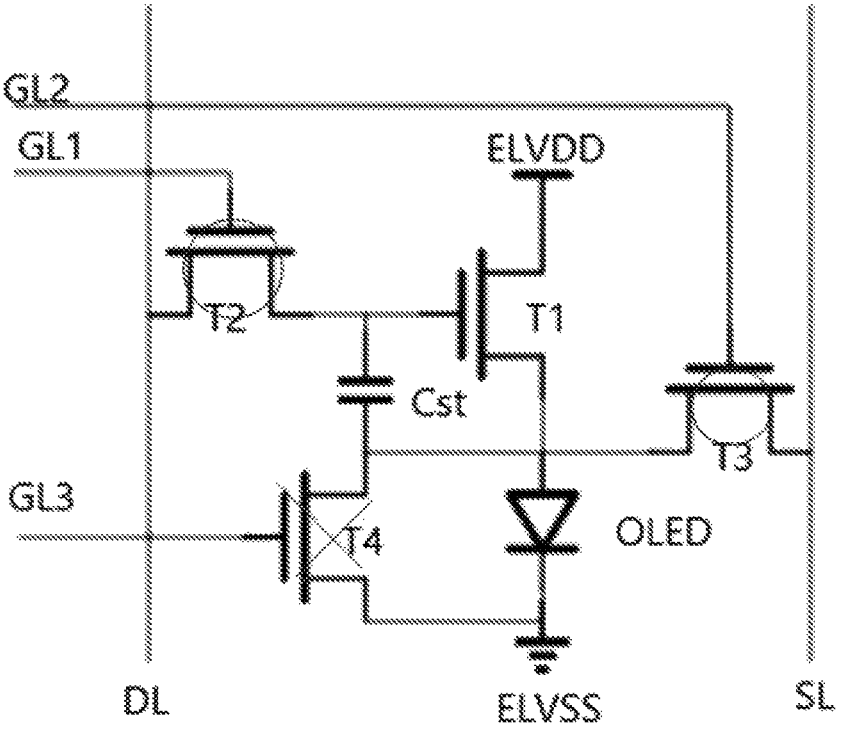
FIG. 6C is a schematic diagram of a working state of the pixel circuit in a charging reset phase t5 according to an embodiment of the present disclosure.

During the charge reset period t5, GL1 and GL2 input a high level, GL3 inputs a low level, as shown in FIG. 6C, T2 and T3 are turned on, T4 is turned off, DL inputs the second reset voltage VREF2, the gate voltage of T1 is reset to VREF2.

In the second detection phase, the voltage of SL continues to rise, and the current flowing through T1 decreases gradually as the source voltage of T1 rises, and the slope of the rising of the voltage of SL gradually decreases, the charging period and the charging reset period are repeated until the current flowing through T1 is 0 (that is, T1 is turned off). The voltage of SL is detected by the source driver. Assuming that the voltage of SL is Vs at this time, the offset compensation value of T1 is VREF2-Vs; for different Vs, different compensation offset values can be obtained.

In FIGS. 6A, 6B, and 6C, circles represent that corresponding transistors are turned on, and crosses represent that corresponding transistors are turned off.

The traditional Vth compensation needs to be performed during shutdown of the display, and in the embodiments of the present disclosure, Vth compensation can be performed in real time, which can effectively compensate for image quality.

In the embodiment of the present disclosure, by setting the voltage value of VREF2 and the duration of the second detection phase, the voltage difference between the anode voltage of the OLED and the ELVSS is smaller than the voltage which enable the OLED to be turned on in the second reset phase t3 and the second detection phase, so that the OLED does not emit light, which will not affect the display.

The parameter detection method according to the embodiment of the present disclosure is applied to the above pixel circuit. The parameter detection method includes the following steps.

Under the control of the reset control signal provided by the reset control line, the reset control circuit controls the connection or disconnection between the first electrode of the light emitting element and the second electrode of the light emitting element. Under the control of the detection control signal provided by the detection control line, the detection control circuit controls the connection or disconnection between the first electrode of the light emitting element and the sensing line. Under the control of the gate driving signal provided by the gate line, the data writing-in circuit controls the connection or disconnection between the data line and the control end of the driving circuit.

In the parameter detection method of the pixel circuit according to the embodiment of the present disclosure, the reset control circuit controls the connection between the first electrode of the light emitting element and the second electrode of the light emitting element in the reset phase under the control of the reset control signal provided by the reset control line, so as to control the light emitting element not to emit light, and the detection control circuit controls the connection or disconnection between the first electrode of the light emitting element and the sensing line under the control of the detection control signal provided by the detection control line, so as to control the reset of the light emitting element by the reset control line, and control the detection switch through the detection control line, so that parameter detection is implemented on the pixel circuit in the non-display row, display driving and parameter detection are performed simultaneously, which can improve the speed of the parameter detection and the speed of voltage compensation on data based on the detected parameter, thereby improving the display quality of the display device.

In specific implementation, the first parameter detection period may include a first reset phase and a first detection phase, and the parameter detection method includes the following steps.

In the first reset phase, under the control of the reset control signal provided by the reset control line, the reset control circuit controls the connection between the first electrode of the light emitting element and the second electrode of the light emitting element to control the light emitting element not to emit light. The data writing-in circuit controls the connection between the data line and the control end of the driving circuit under the control of the gate driving signal provided by the gate line to reset the potential of the control end of the driving circuit to the first reset voltage. Under the control of the detection control signal provided by the detection control line, the detection control circuit controls the connection between the first electrode of the light emitting element and the sensing line to reset the voltage of the sensing line.

In the first detection phase, the reset control circuit controls the disconnection between the first electrode of the light emitting element and the second electrode of the light emitting element under the control of the reset control signal. Under the control of the gate driving signal, the data writing-in circuit controls the disconnection between the data line and the control end of the driving circuit. The detection control circuit controls the connection between the first electrode of the light emitting element and the sensing line under the control of the detection control signal provided by the detection control line. The driving circuit controls the connection between the power supply voltage end and the first electrode of the light emitting element under the control of the potential of the control end of the driving circuit, and generates a charging current flowing from the power supply voltage end to the first electrode of the light emitting element, charges the parasitic capacitance on the sensing line through the charging current to increase the voltage of the sensing line. The compensation gain value of the driving transistor included in the driving circuit may be obtained based on the duration of the first detection phase, the first reset voltage and the voltage of the sensing line at the end of the first detection phase.

In the embodiment of the present disclosure, the first parameter detection period may include a display phase of at least one of other rows of pixel circuits. That is, when the pixel circuit in the embodiment of the present disclosure is in a non-display state, and the compensation gain value of the driving transistor may be detected when the other rows of pixel circuits included in the display panel implements the display.

In specific implementation, the second parameter detection period may include a second reset phase and a second detection phase, the second detection phase includes a plurality of detection sub-phases that are sequentially set, and the detection sub-phase includes a charging time period and a charge reset time period that are sequentially set.

The parameter detection method includes the following steps.

In the second reset phase, under the control of the reset control signal provided by the reset control line, the reset control circuit controls the connection between the first electrode of the light emitting element and the second electrode of the light emitting element to control the light emitting element not to emit light. The data writing-in circuit controls the connection between the data line and the control end of the driving circuit under the control of the gate driving signal provided by the gate line to reset the potential of the control end of the driving circuit to the second reset voltage. Under the control of the detection control signal provided by the detection control line, the detection control circuit controls the connection between the first electrode of the light emitting element and the sensing line to reset the voltage of the sensing line.

During the charging period, the reset control circuit controls the disconnection between the first electrode of the light emitting element and the second electrode of the light emitting element under the control of the reset control signal. The data writing-in circuit controls the disconnection between the data line and the control end of the driving circuit under the control of the gate driving signal. The detection control circuit controls the connection between the first electrode of the light emitting element and the sensing line under the control of the detection control signal provided by the detection control line. The driving circuit controls the connection between the power supply voltage end and the first electrode of the light emitting element under the control of the potential of the control end of the driving circuit, and generates a charging current flowing from the power voltage end to the first electrode of the light emitting element. The charging current is used to charge the parasitic capacitance on the sensing line to increase the voltage of the sensing line.

During the charge reset period, the data writing-in circuit controls the data line to write a second reset voltage to the control end of the driving circuit under the control of the gate driving signal. The detection control circuit controls the connection between the first electrode of the light emitting element and the sensing line under the control of the detection control signal provided by the detection control line, to generate a charging current flowing from the power supply voltage end to the first electrode of the light emitting element, and the charging current is used to charge the parasitic capacitance on the sensing line to increase the voltage of the sensing line.

The compensation offset value of the driving transistor in the driving circuit can be obtained based on the voltage of the sensing line at the end of the last detection sub-phase. Specifically, at the end of the last detection sub-phase, the voltage of the sensing line is increased to a predetermined voltage, so that the driving circuit controls the disconnection between the first end of the driving circuit and the second end of the driving circuit.

In the embodiment of the present disclosure, the second parameter detection period may include a display phase of at least one of other rows of pixel circuits. That is, when the pixel circuit according to the embodiment of the present disclosure is in the non-display state, the compensation offset value of the driving transistor may be detected when the other rows of pixel circuits included in the display panel implement the display.

The display panel according to the embodiment of the present disclosure includes the pixel circuits described above in N rows and M columns. The pixel circuits in the mth column are electrically connected to the mth sensing line. N and M are positive integers, and m is a positive integer less than or equal to M.

Specifically, the pixel circuits in the nth row are electrically connected to the gate line in the nth row, the detection control line in the nth row, and the reset control line in the nth row, n is a positive integer less than or equal to N.

The display device according to the embodiment of the present disclosure includes the above display panel.

Figure 7:
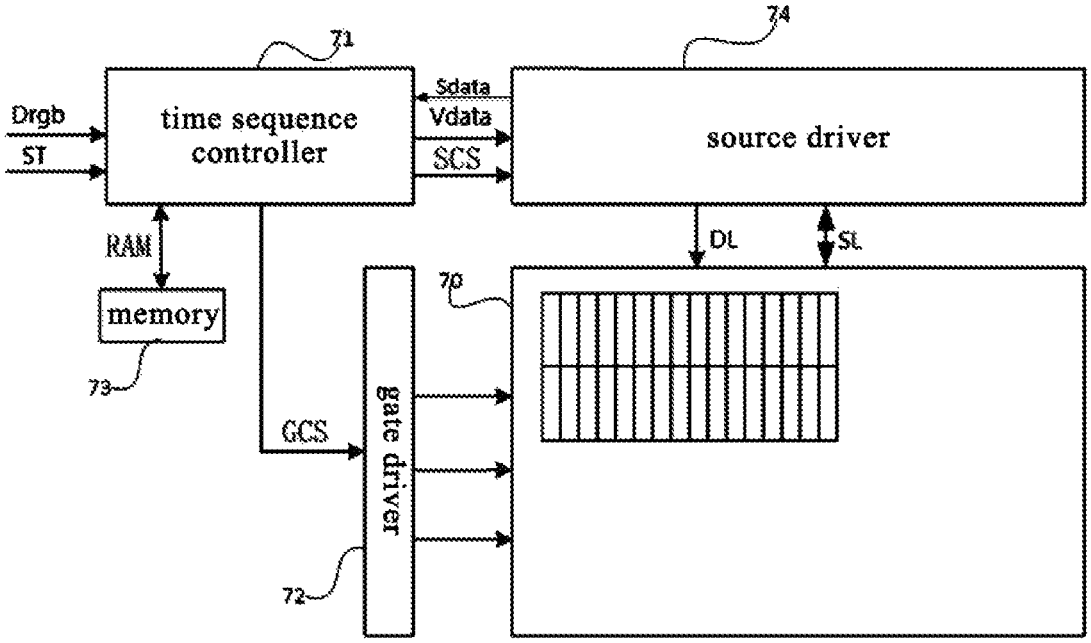
FIG. 7 is a structural diagram of a display device according to an embodiment of the present disclosure.

Specifically, the display device according to the embodiment of the present disclosure may be an OLED display device. As shown in FIG. 7, the display device includes a display panel 70, a time sequence controller 71, a gate driver 72, a memory 73 and a source driver 74, and so on.

The time sequence controller 71 reads the data RAM stored in the memory 73, and simultaneously receives RGB (red, green, blue) data Drgb and time sequence control signal ST inputted externally, and receives the sensing data Sdata outputted by the source driver 74 (the sensing data is the voltage of the sense line detected by the source driver 74); after calculation, conversion and compensation and other algorithms, the time sequence controller 71 generates the data voltage Vdata and the source control signal SCS, and outputs the data voltage Vdata and the source control signal SCS to the source driver 74, and the time sequence controller 74 generates a gate driving signal GCS, and outputs the gate driving signal GCS to the gate driver 72.

The memory 73 stores pixel compensation values of one or more pixels of different pixels on the entire screen in different colors, and the pixel compensation values may include, for example, an offset value Vth for controlling the on-state of the pixels and a gain value K for controlling the change rate of the luminance of the pixels.

The source driver 74 receives the compensated and calculated data voltage Vdata and source control signal SCS outputted by the time sequence controller 71, the entire or part of the pixel feature values of a row is sensed by the sensing line SL, and the sensing data Sdata is generated by an analog-to-digital conversion, and the sensing data Sdata is outputted to the time sequence controller 71. The gate driver 72 receives the gate control signal GCS, generates at least one scan signal, and transmits the at least one scan signal to the display panel (the scan signal includes a detection control signal, a compensation control signal, and a gate driving signal).

As shown in FIG. 7, the source driver 74 detects the voltage of the sensing line SL in the display panel 70 and provides the data voltage to the data line DL in the display panel 70.

Figure 8:
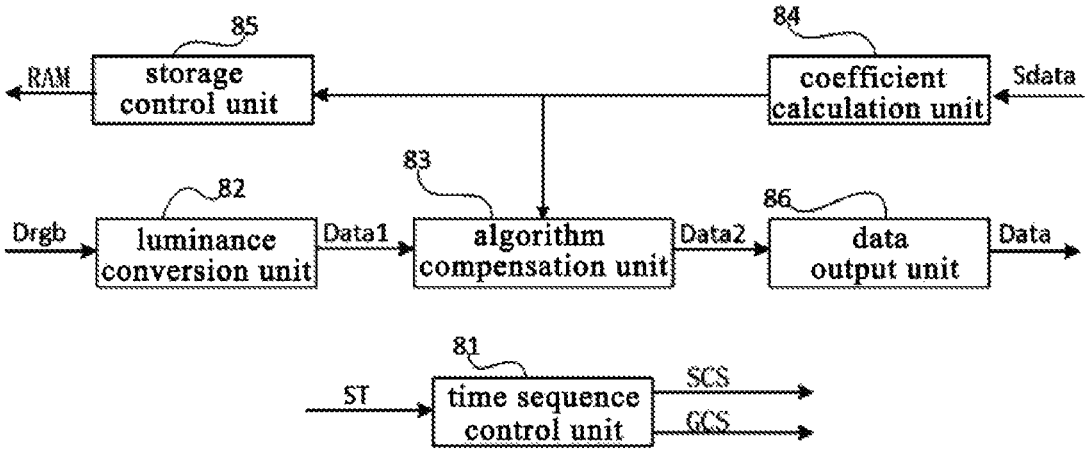
FIG. 8 is a structural diagram of a time sequence controller in a display device according to an embodiment of the present disclosure.

As shown in FIG. 8, the time sequence controller includes a time sequence control unit 81, a luminance conversion unit 82, an algorithm compensation unit 83, a coefficient calculation unit 84, a storage control unit 85, and a data output unit 86.

The time sequence control unit 81 receives the time sequence control signal ST and generates a source control signal SCS for controlling the source driver and a gate control signal GCS for controlling the gate driver. The luminance conversion unit 82 receives the external RGB data Drgb, converts the Drgb into a luminance signal Data1, and outputs the luminance data Data1 to the algorithm compensation unit 83. The algorithm compensation unit 83 receives the luminance data Data1 outputted by the luminance conversion unit 82 and the compensation data outputted by the coefficient calculation unit 84, and outputs a voltage signal Data2 to the data output unit 82 through a pixel compensation algorithm. The data output unit 86 receives the voltage signal Data2, converts Data2 into a digital voltage signal Data, and outputs the digital voltage signal Data to the source driver.

During the first parameter detection period and the second parameter detection period, the coefficient calculation unit 84 receives the sensing data Sdata outputted by the source driver, and converts the Sdata into a compensation offset value Vth and a compensation gain value K on a certain pixel through calculation. After receiving the compensation offset value Vth and the compensation gain value K, the storage control unit 85 writes all or part of the compensation data of a row into the memory under the control of the time sequence control unit 81.

The display device provided in at least one embodiment of the present disclosure may be any product or component with a display function such as a mobile phone, a tablet computer, a television, a display, a notebook computer, a digital photo frame, a navigator, and the like.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

The invention claimed is:

1. A pixel circuit, comprising a data writing-in circuit, a driving circuit, a reset control circuit, a detection control circuit, wherein the data writing-in circuit is electrically connected to a gate line, a data line, and a control end of the driving circuit, respectively, and is configured to control the connection or disconnection between the data line and the control end of the driving circuit under the control of a gate driving signal provided by the gate line;

a first end of the driving circuit is directly electrically connected to a power supply voltage end, a second end of the driving circuit is electrically connected to a first electrode of a light emitting element, and the driving circuit is configured to control the connection or disconnection between the power supply voltage end and the first electrode of the light emitting element under the control of a potential of the control end of the driving circuit;

the detection control circuit is electrically connected to a detection control line, the first electrode of the light emitting element, and a sensing line, respectively, and is configured to control the connection or disconnection between the first electrode of the light emitting element and the sensing line under the control of a detection control signal provided by the detection control line, a second electrode of the light emitting element is electrically connected to a first voltage end; and the reset control circuit is electrically connected to a reset control line, the first electrode of the light emitting element and the second electrode of the light emitting element respectively, and is configured to control the connection or disconnection between the first electrode of the light emitting element and the second electrode of the light emitting element under the control of a reset control signal provided by the reset control line;

the parameter detection method comprises:

controlling, by the reset control circuit, connection or disconnection between the first electrode of the light emitting element and the second electrode of the light emitting element under the control of the reset control signal provided by the reset control line;

controlling, by the detection control circuit, connection or disconnection between the first electrode of the light emitting element and the sensing line under the control of the detection control signal provided by the detection control line; and controlling, by the data writing-in circuit, connection or disconnection between the data line and the control end of the driving circuit under the control of the gate driving signal provided by the gate line; and a first parameter detection period comprises a first reset phase and a first detection phase, and the parameter detection method comprises:

in the first reset phase, the reset control circuit controlling the connection between the first electrode of the light emitting element and the second electrode of the light emitting element under the control of the reset control signal provided by the reset control line to control the light emitting element not to emit light; the data writing-in circuit controlling the connection between the data line and the control end of the driving circuit under the control of the gate driving signal provided by the gate line to reset the potential of the control end of the driving circuit to a first reset voltage; the detection control circuit controlling the connection between the first electrode of the light emitting element and the sensing line under the control of the detection control signal provided by the detection control line to reset the voltage of the sensing line; and in the first detection phase, the reset control circuit controlling the disconnection between the first electrode of the light emitting element and the second electrode of the light emitting element under the control of the reset control signal; the data writing-in circuit controlling the disconnection between the data line and the control end of the driving circuit under the control of the gate driving signal; the detection control circuit controlling the connection between the first electrode of the light emitting element and the sensing line under the control of the detection control signal provided by the detection control line; the driving circuit controlling the connection between the power supply voltage end and the first electrode of the light emitting element under the control of the potential of the control end of the driving circuit, and generating a charging current flowing from the power supply voltage end to the first electrode of the light emitting element, charging parasitic capacitance on the sensing line through the charging current to increase the voltage of the sensing line; and the compensation gain value of the driving transistor included in the driving circuit being obtained based on the duration of the first detection phase, the first reset voltage and the voltage of the sensing line at the end of the first detection phase.

2. The pixel circuit according to claim 1, wherein the reset control circuit comprises a reset control transistor, a control electrode of the reset control transistor is electrically connected to the reset control line, a first electrode of the reset control transistor is electrically connected to the first electrode of the light emitting element, and a second electrode of the reset control transistor is electrically connected to the second electrode of the light emitting element.

3. The pixel circuit according to claim 1, wherein the detection control circuit comprises a detection control transistor, a control electrode of the detection control transistor is electrically connected to the detection control line, a first electrode of the detection control transistor is electrically connected to the first electrode of the light emitting element, and a second electrode of the detection control transistor is electrically connected to the sensing line.

4. The pixel circuit according to claim 1, wherein the first voltage end is a low voltage end.

5. The pixel circuit according to claim 1, wherein the light emitting element is an organic light emitting diode, the first electrode of the light emitting element is an anode of the organic light emitting diode, and the second electrode of the light emitting element is a cathode of the organic light emitting diode.

6. The parameter detection method according to claim 1, wherein the first parameter detection period comprises a display phase of at least one of other rows of pixel circuits.

7. The parameter measurement method according to claim 1, wherein the compensation gain value is a threshold voltage of the driving transistor or a mobility of the driving transistor.

8. The pixel circuit according to claim 1, wherein the data writing-in circuit comprises a data writing-in transistor, a control electrode of the data writing-in transistor is electrically connected to the gate line, a first electrode of the data writing-in transistor is electrically connected to the data line, and a second electrode of the data writing-in transistor is connected to the control end of the driving circuit.

9. The pixel circuit according to claim 8, wherein the driving circuit comprises a driving transistor and a storage capacitor, a control electrode of the driving transistor is electrically connected to the second electrode of the data writing-in transistor, a first electrode of the driving transistor is electrically connected to a power supply voltage end, and a second electrode of the driving transistor is connected to the first electrode of the light emitting element; and a first end of the storage capacitor is electrically connected to the control electrode of the driving transistor, and a second end of the storage capacitor is electrically connected to the second electrode of the driving transistor.

10. The parameter detection method according to claim 1, wherein the second parameter detection period comprises a second reset phase and a second detection phase, the second detection phase comprises a plurality of detection sub-phases that are sequentially set, and the detection sub-phase comprises a charging time period and a charge reset time period that are sequentially set, the parameter detection method comprises:

in the second reset phase, the reset control circuit controlling the connection between the first electrode of the light emitting element and the second electrode of the light emitting element under the control of the reset control signal provided by the reset control line to control the light emitting element not to emit light; the data writing-in circuit controlling the connection between the data line and the control end of the driving circuit under the control of the gate driving signal provided by the gate line to reset the potential of the control end of the driving circuit to the second reset voltage; the detection control circuit controlling the connection between the first electrode of the light emitting element and the sensing line under the control of the detection control signal provided by the detection control line to reset the voltage of the sensing line;

during the charging period, the reset control circuit controlling the disconnection between the first electrode of the light emitting element and the second electrode of the light emitting element under the control of the reset control signal; the data writing-in circuit controlling the disconnection between the data line and the control end of the driving circuit under the control of the gate driving signal; the detection control circuit controlling the connection between the first electrode of the light emitting element and the sensing line under the control of the detection control signal provided by the detection control line; the driving circuit controlling the connection between the power supply voltage end and the first electrode of the light emitting element under the control of the potential of the control end of the driving circuit, and generating a charging current flowing from the power voltage end to the first electrode of the light emitting element, the charging current being used to charge the parasitic capacitance on the sensing line to increase the voltage of the sensing line; and during the charge reset period, the data writing-in circuit controlling the data line to write a second reset voltage to the control end of the driving circuit under the control of the gate driving signal; the detection control circuit controlling the connection between the first electrode of the light emitting element and the sensing line under the control of the detection control signal provided by the detection control line, to generate a charging current flowing from the power supply voltage end to the first electrode of the light emitting element, and the charging current being used to charge the parasitic capacitance on the sensing line to increase the voltage of the sensing line; and the compensation gain value of the driving transistor included in the driving circuit being obtained based on the voltage of the sensing line at the end of the last detection sub-phase.

11. The parameter detection method according to claim 10, wherein at the end of the last detection sub-phase, the voltage of the sensing line is increased to enable the driving circuit to disconnect the first end of the driving circuit from the second end of the driving circuit.

12. The parameter detection method according to claim 10, wherein the second parameter detection period comprises a display phase of at least one of other rows of pixel circuits.

13. A display panel, comprising N rows and M columns of pixel circuits according to claim 1, wherein pixel circuits in the mth column are electrically connected to an mth sensing line;

N and M are positive integers, and m is a positive integer less than or equal to M.

14. The display panel according to claim 13, wherein the pixel circuit in the nth row is electrically connected to a gate line in the nth row, a detection control line in the nth row, and a reset control line in the nth row; n is a positive integer less than or equal to N.

15. A display device, comprising the display panel according to claim 13.

16. The display device according to claim 15, further comprising a time sequence controller, a gate driver, a memory, and a source driver, wherein, the time sequence controller reads data stored in the memory, and simultaneously receives RGB data and a time sequence control signal inputted externally, and receives sensing data outputted by the source driver; the time sequence controller generates a data voltage and a source control signal, and outputs the data voltage and the source control signal to the source driver, and the time sequence controller generates a gate driving signal, and outputs the gate driving signal to the gate driver;

the memory stores pixel compensation values of one or more pixels of different pixels on an entire screen in different colors, and the pixel compensation values include an offset value for controlling an on-state of the pixels and a gain value for controlling a change rate of the luminance of the pixels;

the source driver receives the compensated and calculated data voltage and source control signal outputted by the time sequence controller, the entire or part of the pixel feature values of a row is sensed by the sensing line, and the sensing data is generated by an analog-to-digital conversion, and the sensing data is outputted to the time sequence controller;

the gate driver receives the gate control signal, generates at least one scan signal, and transmits the at least one scan signal to the display panel, the scan signal includes a detection control signal, a compensation control signal, and a gate driving signal;

the source driver detects the voltage of the sensing line in the display panel and provides the data voltage to the data line in the display panel.

17. A parameter detection method applied to a pixel circuit, the pixel circuit includes a data writing-in circuit, a driving circuit, a reset control circuit, a detection control circuit, wherein the data writing-in circuit is electrically connected to a gate line, a data line, and a control end of the driving circuit, respectively, and is configured to control the connection or disconnection between the data line and the control end of the driving circuit under the control of a gate driving signal provided by the gate line;

a first end of the driving circuit is electrically connected to a power supply voltage end, a second end of the driving circuit is electrically connected to a first electrode of a light emitting element, and the driving circuit is configured to control the connection or disconnection between the power supply voltage end and the first electrode of the light emitting element under the control of a potential of the control end of the driving circuit;

the detection control circuit is electrically connected to a detection control line, the first electrode of the light emitting element, and a sensing line, respectively, and is configured to control the connection or disconnection between the first electrode of the light emitting element and the sensing line under the control of a detection control signal provided by the detection control line, a second electrode of the light emitting element is electrically connected to a first voltage end; and the reset control circuit is electrically connected to a reset control line, the first electrode of the light emitting element and the second electrode of the light emitting element respectively, and is configured to control the connection or disconnection between the first electrode of the light emitting element and the second electrode of the light emitting element under the control of a reset control signal provided by the reset control line, wherein the parameter detection method comprises:

controlling, by the reset control circuit, connection or disconnection between the first electrode of the light emitting element and the second electrode of the light emitting element under the control of the reset control signal provided by the reset control line;

controlling, by the detection control circuit, connection or disconnection between the first electrode of the light emitting element and the sensing line under the control of the detection control signal provided by the detection control line; and controlling, by the data writing-in circuit, connection or disconnection between the data line and the control end of the driving circuit under the control of the gate driving signal provided by the gate line, wherein the second parameter detection period comprises a second reset phase and a second detection phase, the second detection phase comprises a plurality of detection sub-phases that are sequentially set, and the detection sub-phase comprises a charging time period and a charge reset time period that are sequentially set, the parameter detection method comprises:

in the second reset phase, the reset control circuit controlling the connection between the first electrode of the light emitting element and the second electrode of the light emitting element under the control of the reset control signal provided by the reset control line to control the light emitting element not to emit light; the data writing-in circuit controlling the connection between the data line and the control end of the driving circuit under the control of the gate driving signal provided by the gate line to reset the potential of the control end of the driving circuit to the second reset voltage; the detection control circuit controlling the connection between the first electrode of the light emitting element and the sensing line under the control of the detection control signal provided by the detection control line to reset the voltage of the sensing line;

during the charging period, the reset control circuit controlling the disconnection between the first electrode of the light emitting element and the second electrode of the light emitting element under the control of the reset control signal; the data writing-in circuit controlling the disconnection between the data line and the control end of the driving circuit under the control of the gate driving signal; the detection control circuit controlling the connection between the first electrode of the light emitting element and the sensing line under the control of the detection control signal provided by the detection control line; the driving circuit controlling the connection between the power supply voltage end and the first electrode of the light emitting element under the control of the potential of the control end of the driving circuit, and generating a charging current flowing from the power voltage end to the first electrode of the light emitting element, the charging current being used to charge the parasitic capacitance on the sensing line to increase the voltage of the sensing line; and during the charge reset period, the data writing-in circuit controlling the data line to write a second reset voltage to the control end of the driving circuit under the control of the gate driving signal; the detection control circuit controlling the connection between the first electrode of the light emitting element and the sensing line under the control of the detection control signal provided by the detection control line, to generate a charging current flowing from the power supply voltage end to the first electrode of the light emitting element, and the charging current being used to charge the parasitic capacitance on the sensing line to increase the voltage of the sensing line; and the compensation gain value of the driving transistor included in the driving circuit being obtained based on the voltage of the sensing line at the end of the last detection sub-phase.

* * * * *